US005337438A

United States Patent [19]

Brown et al.

[11] Patent Number: 5,337,438

[45] Date of Patent: Aug. 16, 1994

[54] METHOD AND APPARATUS FOR CONSTANT PROGRESSION OF A CLEANING JET ACROSS HEATED SURFACES

[75] Inventors: Clinton A. Brown, Baltimore; William E. Hellyer, Lancaster; John T. Huston, Lancaster; Anthony W. Dickman, Reynoldsburg, all of Ohio

[73] Assignee: The Babcock & Wilcox Company, New Orleans, La.

[21] Appl. No.: 877,987

[22] Filed: May 2, 1992

[51] Int. Cl.[5] ..... F22B 37/52

[52] U.S. Cl. ..... 15/318.1; 122/390

[58] Field of Search ..... 15/316.1, 318, 318.1; 122/379, 390

[56] References Cited

U.S. PATENT DOCUMENTS

| | | | |
|---|---|---|---|
| Re. 32,517 | 10/1987 | Nelson | 122/379 |
| 3,230,568 | 1/1966 | Saltz | 15/317 |
| 3,344,459 | 10/1967 | Jankowski | 15/317 |
| 4,437,201 | 3/1984 | Zalewski | 15/316.1 |
| 4,492,187 | 1/1985 | Hammond | 122/390 |
| 4,527,515 | 7/1985 | Hester | 15/318.1 |
| 4,718,376 | 1/1988 | Leroueil et al. | 122/390 |
| 4,803,959 | 2/1989 | Sherrick et al. | 122/379 |

*Primary Examiner*—Chris K. Moore

*Attorney, Agent, or Firm*—Harness, Dickey & Pierce

[57] ABSTRACT

An apparatus for cleaning heated surfaces with substantially constant progression of a jet cleaning medium. The invention monitors the rotational and translational position of the lance tube and is programmed with a schedule of lance tube rotation rates and blowing medium discharge rates for the specific configuration of the heated surfaces. Based upon the rotational and translational position of the lance tube and the distance the jet travels before impinging upon the heated surfaces, the rate of rotation of the lance tube is varied throughout every rotation to maintain substantially constant progress of the jet across the heated surfaces.

13 Claims, 4 Drawing Sheets

METHOD AND APPARATUS FOR CONSTANT PROGRESSION OF A CLEANING JET ACROSS HEATED SURFACES

BACKGROUND OF THE INVENTION

This invention relates generally to a sootblower device for directing a fluid spray against a heat exchanger surface and particularly to such a device providing improvements in the uniformity of the cleaning effect provided.

Cleaning highly heated surfaces, such as the heat exchange surfaces of a boiler, furnace or the like, has commonly been performed by devices generally known as sootblowers. Sootblowers typically employ water, steam, air, or a combination thereof, as a blowing medium which is directed through a nozzle against encrustations of slag, ash, scale, and/or other fouling materials which become deposited on the heat exchange surfaces. Sootblowers of the retracting variety employ a lance tube which is advanced into the boiler through a wall port and have one or more nozzles through which the cleaning medium is discharged.

It has long been known that water in liquid form, either used alone or in combination with a gaseous blowing medium, increases the ease with which the encrustations are dislodged. The effectiveness of water in dislodging the encrustations results from a thermal shock effect coupled with mechanical impact. The thermal shock shrinks and embriddles the encrustations resulting in a fracturing of the encrustations so that they become dislodged and fall away because of the mechanical impact.

Unfortunately, to obtain sufficient cleaning in accordance with the water spray process mentioned above, the danger of overstressing the hot surfaces is present. In fact, rapid deterioration of the heat exchange surfaces as a result of the thermal shock has been seen. The problem of heat exchange surface deterioration has been particularly severe in connection with cleaning the rigidly held tube bundles of large scale boilers. Being rigidly held, the tubes cannot readily distort in response to the temperature induced shrinkage and expansion occurring during a cleaning cycle. Difficulties are present in an effort to produce adequate cleaning performance while avoiding thermal overstressing since the surfaces to be cleaned are of varying distances from the nozzle and therefore a varying speed of jet progression across the heat exchanger surfaces occurs. Areas of slow progression may receive excessive thermal shock whereas areas of fast progression may not be provided an adequate cleaning effect.

Another significant consideration in sootblower operations is the cost effectiveness of operation. Sootblowers have a significant power requirement for operation, use a large quantity of cleaning medium, and place a thermal load on the boiler.

One method previously used in an attempt to control the induced thermal shock and provide for efficient sootblower operation, involved throttling the blowing medium. The blowing medium was throttled in a manner such that the amount of blowing medium striking the different surfaces of the heat exchanger would remain substantially constant. For example, when cleaning the wall through which a retractable sootblower lance is inserted and rotated, the jet of the blowing medium, when projected back toward the wall, traces an increasing diameter spiral path as the extended length of the lance increases. To maintain the amount of blowing medium striking the different surfaces of the wall substantially the same, the flow rate of the blowing medium can be reduced when the blowing medium is discharged against surfaces close to the lance and increased as the blowing medium was discharged against surfaces farther away from the lance. By varying the rate of discharge, the total quantity of blowing medium striking incremental areas can be maintained constant. This approach, however, has the disadvantage that the jet velocity decreases with flow rate through the lance nozzle. This decreased jet velocity has been found to degrade cleaning performance by reducing the mechanical impact force, which coupled with thermal shock, cleans the heat exchange surfaces.

Another approach toward providing a more uniform cleaning effect is to provide a control mechanism for a wall blower that varies the rotational and translational speed of the lance during the cleaning cycle of a retractable sootblower. If a constant motor speed is utilized, the angular rate of rotation will be constant and the rate of travel of the jet's impingement point, with respect to the wall surface, will be slower in the smaller diameters of the spiral, e.g. where the nozzle is close to the wall, and will be fastest where the spiral diameters are greatest and the lance is near full insertion. By decreasing the speed of the motor, it is possible to maintain relatively constant jet progression over the entire course of the spiral by decreasing the rate of rotation of the lance as the jet impinges against the wall in those spiral areas of larger diameter. Thus, the rate of rotation of the lance is solely a function of the extension distance of the lance or nozzle into the boiler. The assignees of this invention, the Babcock & Wilcox Company, have been granted U.S. Pat. No. 3,782,336 (and reissue thereof Re. 32,517) encompassing such a wall cleaning sootblower.

A drawback of the above approach is that it is limited in its applicability. The method works satisfactorily for a wall blower where the surface to be cleaned is generally perpendicular to the insertion axis of the lance. However, the result is unsatisfactory when the surfaces to be cleaned are not oriented such that the jet progression rate is a simple function of the lance extension distance.

SUMMARY OF THE INVENTION

With the above and other limitations in mind, it is an object of this invention to provide a method and apparatus which are capable of cleaning heated surfaces, regardless of surface configuration, with a substantially constant jet progression.

The sootblower of this invention is preferably used with water as the cleaning medium and includes a carriage assembly having a motor coupled to a drive train which provides for lance rotation and translation. A first position encoder is coupled to the input shaft of drive train and monitors the rotational position of the lance and the nozzles. A second position encoder is mounted to monitor the translation movement of the lance tube and nozzles. Signals from the position encoders are provided to a controller which determines both the rotational and translational position of the lance and nozzle. The controller is programmed with a rate of rotation schedule corresponding with the specific configuration of the heated surfaces within the boiler. Upon determining the position of the nozzle and comparing it to the rate of rotation of the schedule, the controller utilizes a feedback loop, coupled to the motor, to adjust the rate of rotation of the lance so that a substantially constant progression rate of the jet across the heated surfaces is maintained over the entire course of insertion and retraction.

The controller is also coupled to the control system which operates the supply of blowing medium. Depending on the position of the lance and nozzles, the supply of blowing medium is varied according to a programmed schedule to reduce the discharge of the blowing medium at times during insertion and retraction when the discharge would result in inefficient cleaning, in damage to the heat exchange tubes themselves or would be undesirable from a cost and power consumption standpoint.

As will be readily apparent from the description more fully set out below, the present invention can be programmed to maintain substantially constant jet progression, regardless of the orientation of the heated surfaces relative to the lance and nozzle, while reducing overall power consumption costs.

Additional benefits and advantages of the present invention will become apparent to those skilled in the art to which this invention relates from the subsequent description of the preferred embodiments and the appended claims taken in conjunction with the accompanying drawings.

DETAILED DESCRIPTION OF THE PREFERRED EMBODIMENT

Now with reference to the drawings, the present invention provides for an apparatus and method of maintaining a substantially constant rate progression of a blowing medium jet across the heated surfaces of a large scale industrial boiler.

Figure 1:
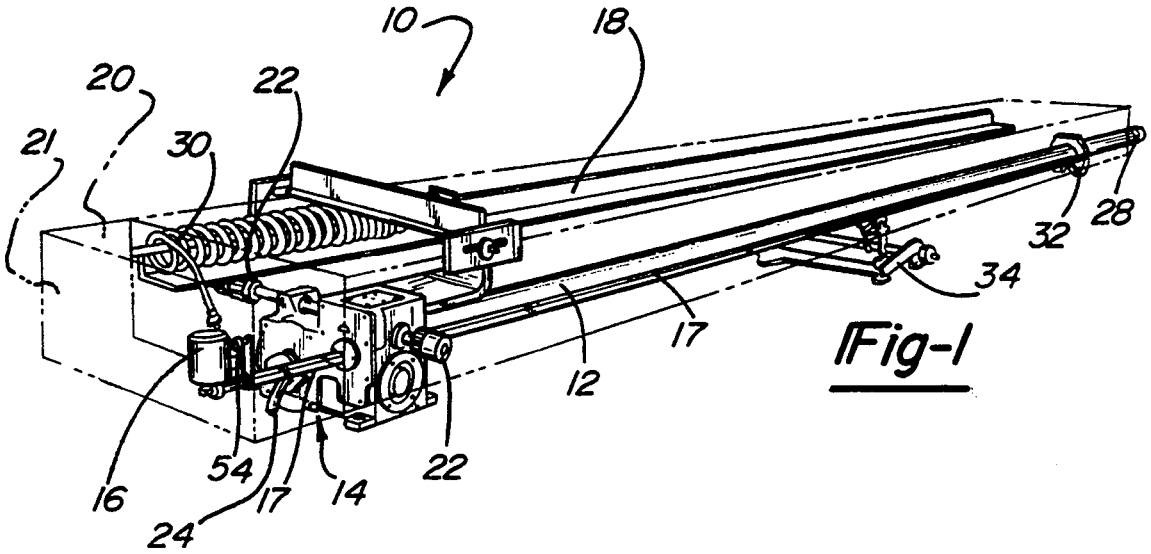
FIG. 1 is a perspective view of a sootblower assembly embodying the principles of the present invention.

A sootblower of the long retracting variety incorporating the features of the present invention is shown in FIG. 1 and designated by reference character 10. This sootblower 10 is generally of the type described in U.S. Pat. No. 3,439,376 which is assigned to the assignee of this invention and hereby incorporated by reference. Sootblowers 10 of the general variety shown in FIG. 1 are well known within the art of boiler cleaning and often incorporate numerous additional features which are not shown in the Figures. However, such details are not necessarily involved in the present invention. As will be more apparent from the discussion that follows, the principles of the present invention will have applicability to sootblowers in general and in particular to the type incorporating a retractable lance. These principles additionally have applicability to both the oscillating and revolving lances found in sootblowers.

A lance tube 12 is reciprocally inserted into a boiler or furnace 36 to clean the heat exchange surfaces and other interior surfaces by discharging the blowing medium in a jet against these surfaces. The lance tube 12 is mounted to a carriage assembly 14 and a motor 16 controls both the movement of the carriage assembly 14 and rotation of the lance tube 12. Mounted to a frame box 20, the motor 16 is coupled to the lance tube 12 through a primary input shaft 17 and drive train (not shown) so as to simultaneously impart rotational and translational motion to the lance tube 12. An electrical cable 30 conducts power to the motor 16.

The primary input shaft 17 is a square shaft that extends the substantial length of the frame box 20 that forms the protective housing for the entire sootblower 10. The primary input shaft 17 also extends through the carriage assembly 14. In the carriage assembly 14, a nylon bushing (not shown) is fitted onto the primary input shaft 17 so as to rotate therewith. Rotation of the bushing drives the remaining portions of the drive train causing longitudinal or translational movement of the carriage assembly 14. For this reason, the bushing is also capable of sliding along the length of the primary input shaft 17 while maintaining the rotary input therefrom. The drive train is of a fixed ratio and, therefore, for a given amount of longitudinal or translational movement of the carriage assembly 14, a corresponding amount of translational and rotational movement will be imparted to the lance tube 12.

To permit translational motion, the carriage assembly 14 travels on rollers 19 along a pair of tracks 18 (only one of which is shown) which are rigidly connected to a frame box 20 which forms a housing for the entire sootblower 10. The tracks 18 include toothed racks (not shown) which are engaged by pinion gears 22 of the drive train to induce translation of the carriage.

A resilient or flexible feed tube 24 extends in through one end of the carriage assembly 14 and conducts blowing medium to the lance tube 12. The feed tube 24 is supported so as to extend and follow the carriage assembly 14 as it travels through its insertion and retraction movements. The blowing medium itself is governed by a control mechanism as set forth in the co-pending application entitled "SOOTBLOWER WITH LANCE BYPASS FLOW", application Ser. No. 07/877,641, which subsequently issued as U.S. Pat. No. 5,237,718, and which has been assigned to the assignee of the present invention. However, the supply of blowing medium can be controlled by any system which offers the desired control characteristics that are more fully set out below.

The lance tube 12 overfits a portion of the feed tube 24 and a fluid seal between them is provided by a packing gland (not shown). In this manner, blowing medium is conducted into the lance tube 12 for discharge from nozzles 28 located on the distal end of the lance tube 12. The sootblower 10 is additionally provided with a front support bracket 32 that includes bearings to support the lance tube 12 during its translational and rotational movement. Depending upon the length of the lance tube 12, intermediate supports 34 may be provided to prevent excessive deflection in the lance tube 12.

Figure 2:
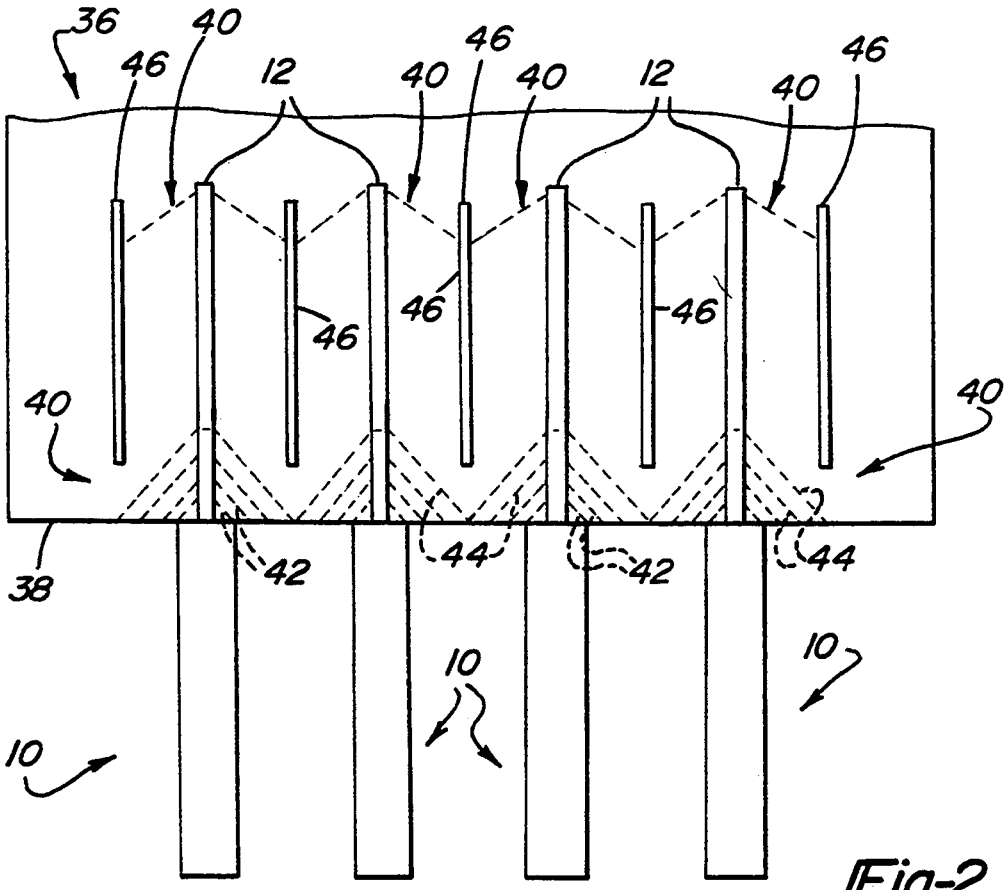
FIG. 2 is a diagrammatic plan view of an array of sootblowers being used to clean various heated surfaces in a large scale boiler.

Referring now to FIG. 2, as the lance tube 12 is advanced, the distal end of the lance tube 12 will enter into the boiler 36 through a wall 38 provided with a port (not designated) specifically designed to accept the lance tube 12. A result of the direct gear interconnection between the translation and rotational movement is that a helical path is traced by jets of blowing medium, generally designated at 40 in FIG. 2, during both the extension and retraction movements of the lance tube 12 for a conventional sootblower 10. The sootblower 10 might employ a lost motion or other indexing device to vary the helical paths traced by the jets 40 between insertion and retraction of successive operating cycles.

Upon initial rotation and insertion of the lance tube 12 through the boiler wall 38, the jet 40 of blowing medium, which is directed rearward in the present embodiment, traces a small spiral path around the lance tube 12. The small spiral path is a result of the short distance of travel from the nozzle 28 to the interior surface, in this case the boiler wall 38, which is being cleaned. As the lance tube 12 is further inserted into the boiler 36, the diameter of the spiral path increases in proportion to the distance from the nozzle 28 to the boiler wall 38. In the figures, the shorter distances of travel for the jets 40 are designated by reference character 42 while the longer distances of travel for the jets 40 are designated by reference characters 44.

As is readily apparent, under a constant rate of rotation, the rate of linear travel of the point of impingement of the jet with the surface of the wall 38 is much slower in those areas where the nozzle 28 is close to the wall 38 (travel distances 42) and very much faster in those areas where the distance from the nozzle 28 to the heat exchange surface is greatest (travel distances 44). Therefore, to maintain a constant rate of jet progression, the rotational speed of the lance tube 12 needs to be increased in the areas of short jet travel 42 and slowed in those areas of long jet travel 44. For a given nozzle 28 backrake angle, this is directly proportional to the length of the lance tube 12 which has been axially inserted into the boiler 36.

Furthermore, as the lance tube 12 is inserted and the spirals widen, the jets 44 from adjacent sootblowers 10 begin to overlap in their cleaning of the boiler wall 38. It is desirable to limit this overlap for several reasons. First, once the area of the wall 38 has been cleaned, redundant cleaning is unnecessary and results in blowing medium being "wasted". Additionally, after the encrustations have been removed, further thermal shock and mechanical impact to the cleaned heat exchange surfaces by the blowing medium can result in overstressing and erosion of these surfaces. To prevent the above from occurring, the discharge of blowing medium is reduced during the sweep of the nozzle over the areas of overlap once the overlapping begins. The mechanism employed to slow the flow of blowing medium in these areas is more fully discussed below.

The above discussion has only been concerned with the cleaning of heated surfaces or walls 38 which are perpendicular to the insertion axis of the lance tube 12 and is partially encompassed by U.S. Pat. No. 3,782,336 mentioned previously. When cleaning surfaces which are not configured perpendicular to the insertion axis of the lance tube 12, additional considerations must be taken into account. If the configuration of the heated surfaces, which are not perpendicular to the insertion axis of the lance tube 12, are known relative to the lance tube 12, the manner in which the rate of rotation must be varied to provide substantially constant jet progression across the heated surfaces can be determined based on the distance from the heated surface to the nozzles 28.

Figure 3:
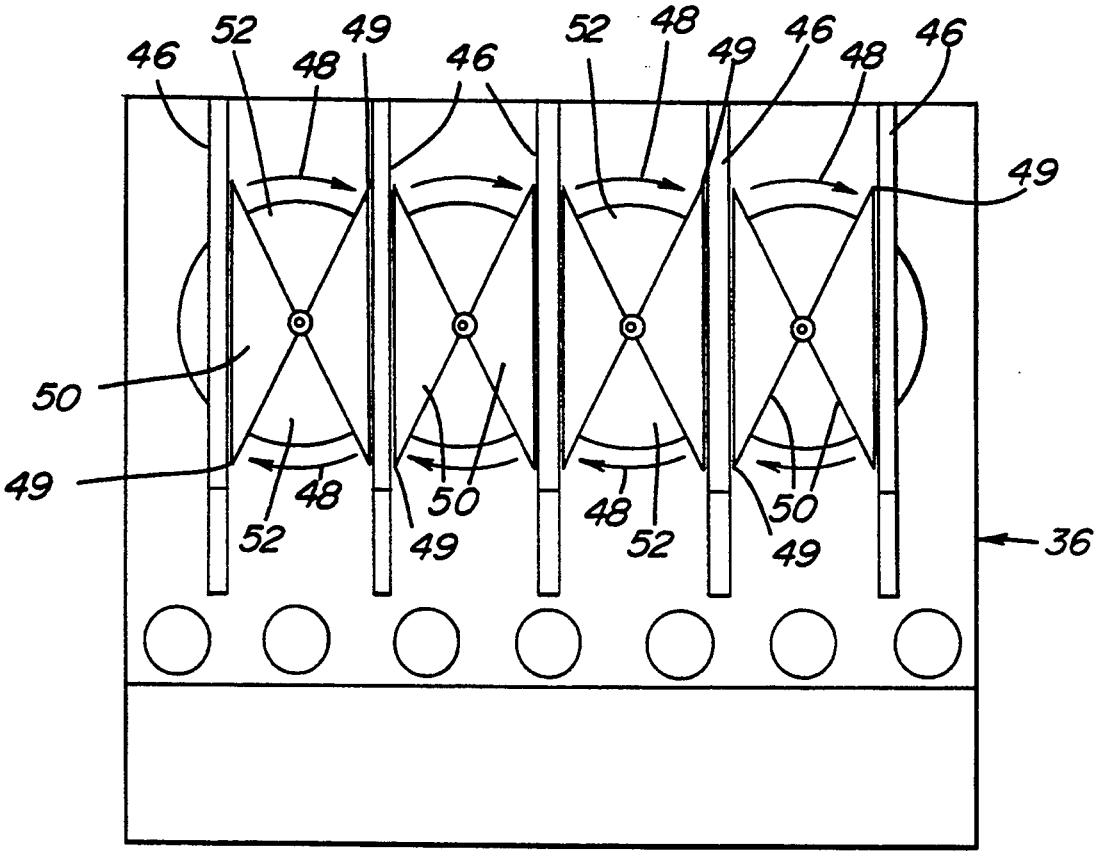
FIG. 3 is a diagrammatic front elevational view illustrating further operation of the sootblowers shown in FIG. 2.
Figure 4:
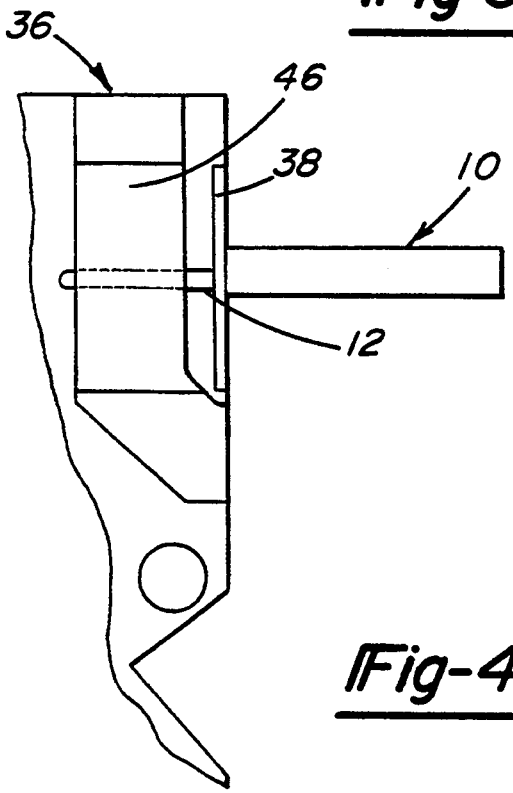
FIG. 4 is a partial side elevational view of the sootblowers illustrated in FIGS. 2 and 3 generally showing their relative positions in a large scale boiler.

As seen in the elevational view of FIG. 3, the lance tube 12 is being inserted into the boiler 36 along an axis which would extend out of the plane of the drawing. Vertical heated surfaces, often referred to as divider walls or wing walls 46, extend generally parallel to one another at a spaced distance from the insertion axis. As the lance tube 12 is inserted and rotated, rotation being in the direction designated by arrows 48, the point of impingement of the jet will travel up along the surface of one wing wall 46 and then downward along the surface of the immediately adjacent wing wall 46.

As is readily apparent from FIG. 3, from the point of initial impingement, designated at 49, as the jet travels up a wing wall 46 (or down the adjacent wing wall 46) during rotation of the lance tube 12, the distance from the nozzle 28 to the point of impingement against the wing wall 46 decreases until the jet 40 is being projected substantially horizontally from the nozzle 28 against the wing wall 46. Thereafter, this distance increases as the jet 40 continues to progress up the wing wall 46 (or down the adjacent wing wall 46). It follows that for a constant rate of rotation, the rate of linear travel of the point of impingement of the jet 40 along the surface of the wing wall 46 will be much slower in those areas which are substantially horizontal with the lance tube 12 and very much faster in those areas near initial and final impingement resulting in uneven cleaning. To prevent this from occurring, the rotational speed of the lance tube 12 is again varied. Additionally, if blowing medium is discharged as the lance tube 12 is rotated across the distance between the immediately adjacent wing walls 46, blowing medium will be ineffectually applied and wasted because of its failure to impinge upon a surface requiring cleaning.

In accordance with this invention, the rotation rate during a single rotation of the lance tube 12 is varied as the point of impingement of the jet 40 progresses up one wing wall 46, across the gap between adjacent wing walls 46 and then down along the opposing wing wall 46. Additionally, it is desirable to greatly speed up the rate of rotation and reduce the discharge rate of the blowing medium as the nozzle 28 is transferred from being directed at one wing wall 46 to the immediately adjacent wing wall 46. In FIG. 3, reference character 50 designates those areas where effective impingement of the jet 40 against the wing walls 46 occurs. The areas where impingement of the jet 40 is ineffective are designated by reference character 52. In the interest of clarity, only a representative number of these areas 50 and 52 are specifically designated.

To control the rotation rate of the lance tube 12 and thereby maintain substantially constant jet progression during the cleaning cycle, the present invention incorporates features which enable monitoring of the rotational position of the lance tube 12 and the nozzle 28. This is achieved by coupling two position encoders 54 and 55, of a type well known, to the sootblower 10.

The first position encoder 54 is coupled to the primary input shaft 17 of the drive train and is mounted to a rearward bulkhead 21 of the frame box 20. Coupling to the primary input shaft 17 is accomplished by a timing belt or chain 56 that extends over a pair of pulleys 58 and 60, respectively mounted to the position encoder 54 and the primary input shaft 17.

Figure 5:
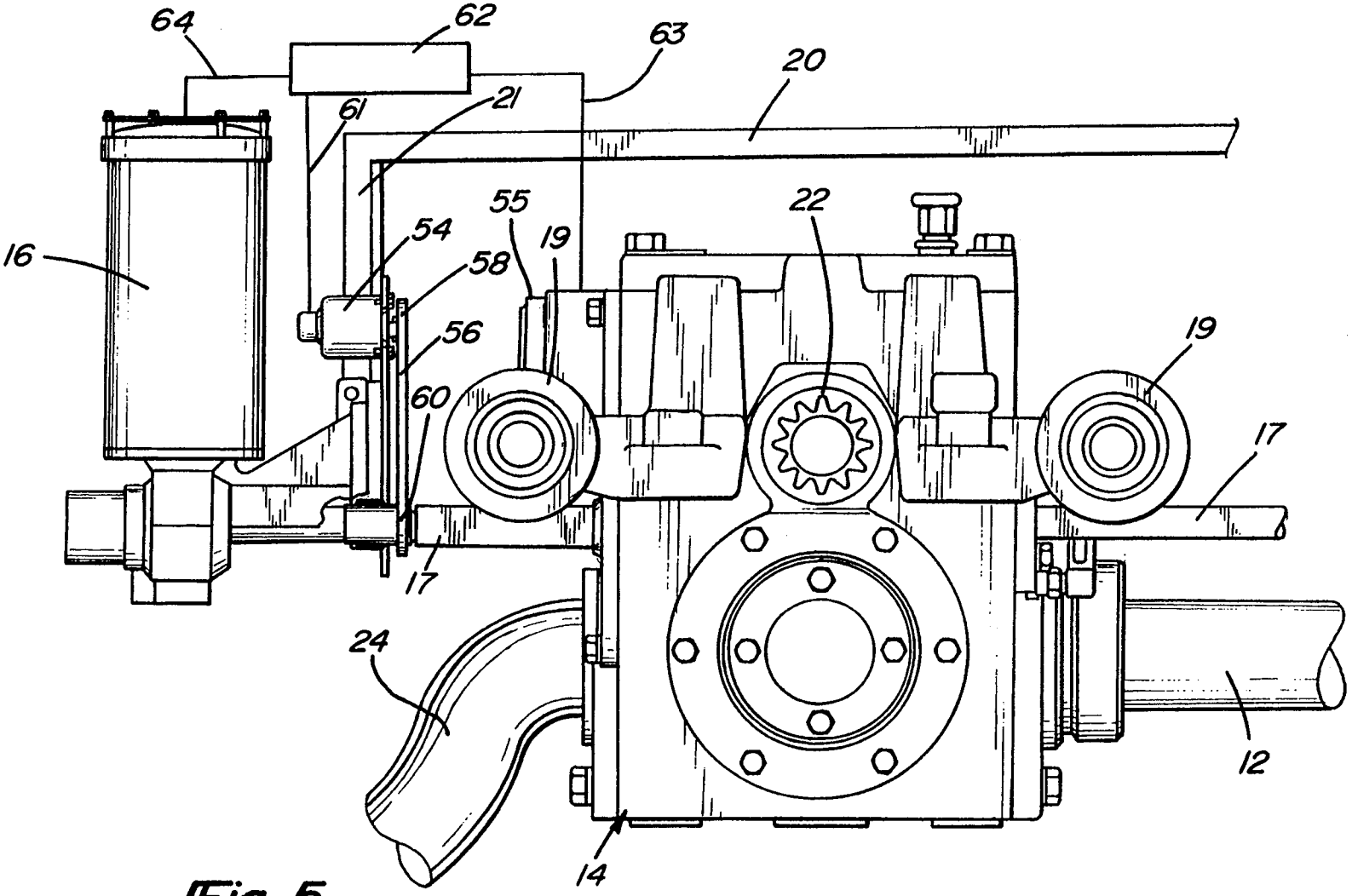
FIG. 5 is a side elevational view of the carriage assembly of the sootblower shown in FIG. 1 further illustrating the drive motor, position encoder and controller utilized by the present invention.

As seen in FIG. 5, the first position encoder 54 is connected by a lead 61 to a programmable controller 62, which may incorporate a common microprocessor. The first position encoder 54 provides an output signal, or numbers of counts, for each rotation of the primary input shaft 17. The controller 62 utilizes the counts to determine the rotational position of the nozzle 28, based upon the known relation of input shaft 17 rotation and lance tube 12 rotation. Since the precise position of the nozzle 28 is desired, the number of counts registered by the first position encoder 54 for one revolution of the lance tube 12 should be high. In one working embodiment of the present invention, 956 counts or pulses are provided for a single revolution of the lance tube 12.

The translational position of the lance tube 12 and the nozzle 28 are monitored by the controller 62 through the second position encoder 55, which is connected thereto by a wire lead 63. The second position encoder 55 specifically monitors the number of revolutions which the lance 12 has undergone and produces an output or pulse for each revolution. In the working embodiment, the drive train produced two inches of longitudinal travel or translation movement for each revolution of the lance tube 12.

While one of the position encoders 54 or 55 will locate the rotational and translational position of the lance tube 12 and nozzle 38 because of the fixed gear connection with the drive train, by using two position encoders count errors can be overcome and precise positioning of the nozzle 28 more readily known for both rotational speed and blowing medium control.

The controller 62 is connected to the motor 16 through a feedback loop 64 which allows the controller 62 to either increase or decrease the output of the motor 16 thereby varying the rate of rotation of the lance tube 12. The controller 62 is programmed with a schedule corresponding to the specific configuration of the heat exchange and other interior surfaces of the boiler 36 as they relate in terms of their distances from the nozzle 28 during cleaning. Since the position of the lance tube 12 and nozzle 28 are known, the rate of rotation can be varied during a single revolution of the lance tube 12 to maintain substantially constant jet progression throughout the entire operating cycle of the sootblower 10. Because of the need to vary the rotational rate of lance tube 12, it is preferred that the motor 16 be of an AC variety, enabling speed control through a variable frequency power supply. The controller 62 is also coupled to control the supply rate of the blowing medium by comparing the nozzle 28 position to a programmed discharge rate schedule.

Figure 6:
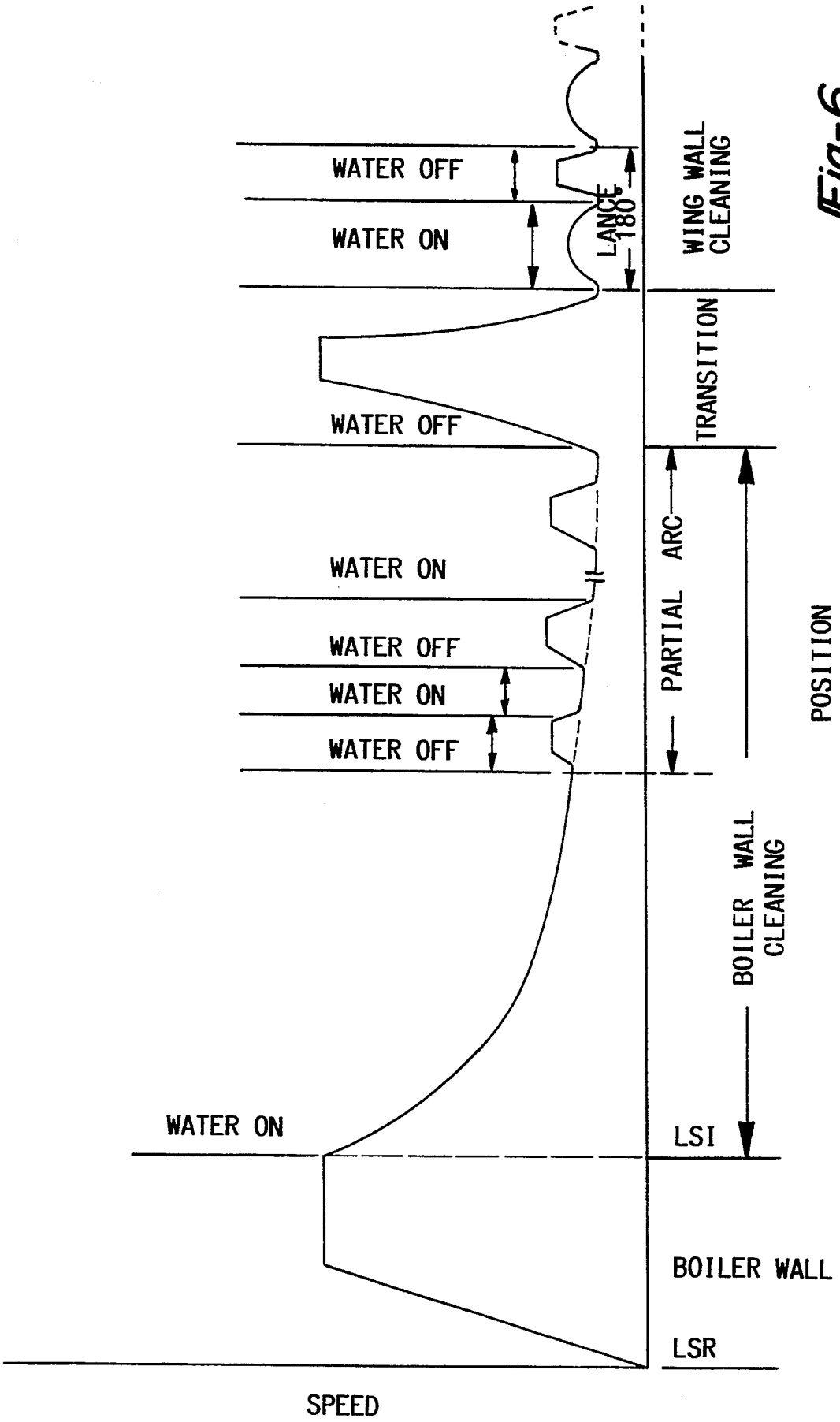
FIG. 6 is a speed vs. position graph of the lance tube of the invention during an insertion cycle.

Referring now to the speed v. position graph shown in FIG. 6, operation of the present invention during an insertion cycle will be discussed in terms of the position of the lance tube 12 and its rotational speed.

At the beginning of the insertion cycle, a limit switch (LSR) is reset by the full retraction of the carriage assembly 14. As the carriage assembly 14 begins to advance, the rotational speed increases and the lance tube 12 and nozzle 28 begin to advance and rotate. Preferably, the lance tube 12 will reach its first desired rotational speed as it passes through the boiler wall 38. Upon entering into the boiler 36 through the boiler wall 38, an initializing limit switch (LSI) is triggered turning on the discharge of medium and beginning the registering in the controller 62 of the counts produced by the position encoders 54 and 55. Immediately, the controller 62 begins to continuously compare the position of the lance tube 12 and nozzle 28, based on the registered counts, to the programmed rate of rotation schedule. As the lance tube 12 is inserted and the distances which the jets 40 must travel before impacting the heat exchange surfaces increase, the rate of rotation is gradually slowed. The decrease in rotational speed continues until the spirals traced by the jets 44 of the adjacent sootblowers 10 begin to overlap.

After overlapping begins, when a nozzle 28 is directed toward an already cleaned surface as determined by the position encoders 54 and 55, the controller 62 compares the positions to the programmed schedules and, according to the schedules, speeds up the rotational speed of the lance tube 12 and reduces the discharge of the blowing medium down to a rate that is sufficient only to cool the lance tube 12. This cooling discharge rate is indicated in FIG. 6 by the "WATER OFF" designations. Thus, during the overlap, the jet 40 is emitted at its cleaning rate only during a partial arc of the spiral. This accomplishes several things. First, it reduces erosion of the "cleaned" heat exchange surfaces due to overstressing. Second, it reduces the amount of blowing medium which is consumed for a given cleaning cycle. Third, it reduces the overall time required for completion of the cleaning cycle. And fourth, the power consumption during the cleaning cycle is reduced.

Once the boiler wall 38 has been substantially cleaned, the lance tube 12 may need to be inserted a certain distance before the jets will impact the wing walls 46. During this "transition", the rate at which the blowing medium is provided is reduced to the cooling rate and the rotational rate of the lance tube 12 is increased to further reduce the duration of the cleaning cycle. Prior to the point where the jets would initially engage the wing walls 46, the rotational speed is decreased and the blowing medium increased to its cleaning discharge rate. In FIG. 6, the cleaning discharge rate is indicated by the "WATER ON" designation.

As the jet of blowing medium progresses up the wing wall 46, the distance from the nozzle 28 to the impingement point decreases and the rotational speed of the lance tube 12 is increased. After the nozzle 28 passes a horizontal orientation, the distance increases and the rotational speed is decreased. When the nozzle 28 and the jet are directed so as to sweep between the wing walls 46 in the area designated by 52, the rotational speed is again increased and discharge of the blowing medium reduced to the cooling rate.

When the nozzle 28 is directed so that impingement of the jet against the wing wall 46 will again occur, the lance tube 12 will have rotated one hundred and eighty degrees (180°) since being inserted between the wing walls 46 and the wing wall cycle begins again. The cycle is repeated until the entire length of the wing walls 46 has been cleaned.

After the cleaning cycle has been completed, the carriage assembly 14 retracts the lance tube 12 and the limit switch (LSR) is reset preparing the assembly for the next cycle.

While the above description constitutes the preferred embodiment of the present invention, it will be appreciated that the invention is susceptible to modification, variation and change without departing from the proper scope and fair meaning of the accompanying claims.

What is claimed is:

1. An apparatus for cleaning heated surfaces in a combustion device such as a boiler or furnace comprising:

a carriage assembly including a lance tube, said lance tube having a nozzle at one end and further being coupled to a source providing a blowing medium to be discharged from said nozzle in a jet directed to impinge against said heated surfaces and clean said heated surfaces;

drive train means for providing rotational and translation movement of said lance tube, said drive train means including motor means for causing said rotational and translational movement of said lance tube; and control means coupled to said motor means for varying the rate of said rotational movement of said lance tube, said control means including means for monitoring said rotational and translational positions of said lance tube said control means further including a memory device having a schedule of lance tube rates of rotation stored therein corresponding to various positions of said lance tube and said nozzle, said schedule being derived as a function of both the rotational and longitudinal positions of said nozzle and the distance of travel of said jet from said nozzle to said heated surfaces, said control means varying said rate of rotation of said lance tube based upon said schedule.

2. An apparatus as set forth in claim 1 wherein said monitoring means is a position encoder.

3. An apparatus as set forth in claim 2 wherein said drive train means includes an input shaft driven by said motor means and said position encoder is coupled to said input shaft.

4. An apparatus as set forth in claim 3 wherein said position encoder is coupled to said input shaft by a timing belt.

5. An apparatus as set forth in claim 1 wherein said monitoring means includes a first position encoder means for monitoring said rotational position and a second position encoder means for monitoring said translational position.

6. An apparatus as set forth in claim 1 wherein said control means is programmable.

7. An apparatus as set forth in claim 1 wherein said control means includes a microprocessor.

8. An apparatus as set forth in claim 1 wherein said control means receives signals from said means for monitoring thereby defining a feedback loop.

9. An apparatus as set forth in claim 1 wherein said motor means comprises an AC motor and said control means includes a variable frequency power supply for said AC motor enabling speed control of said AC motor.

10. An apparatus as set forth in claim 1 wherein said control means is coupled to said motor means by a feedback loop, said control means comparing the rotational and longitudinal positions of said lance tube and said nozzle as indicated by said means for monitoring to said schedule and varying said rate of said rotational movement according to said schedule.

11. An apparatus as set forth in claim 1 wherein said control means includes means for controlling flow rates of said blowing medium discharged from said nozzle.

12. An apparatus as set forth in claim 11 wherein said memory device has a schedule of blowing medium discharge rates stored therein corresponding to various positions of said lance tube and said nozzle, said schedule of blowing medium discharge rates being derived as a function of both the rotational and longitudinal positions of said nozzle and the distance of travel of said jet from said nozzle to said heated surfaces.

13. An apparatus as set forth in claim 1 wherein said control means continuously varies said rate of rotation of said lance tube.

* * * * *